US006491060B2

(12) United States Patent
Struthers

(10) Patent No.: US 6,491,060 B2
(45) Date of Patent: Dec. 10, 2002

(54) CONTROLLED SEWAGE SUMP NETWORK SYSTEM

(75) Inventor: Kevin D. Struthers, Coatesville, PA (US)

(73) Assignee: Little Giant Pump Company, Oklahoma City, OK (US)

( * ) Notice: Subject to any disclaimer, the term of this patent is extended or adjusted under 35 U.S.C. 154(b) by 0 days.

(21) Appl. No.: 09/879,019

(22) Filed: Jun. 12, 2001

(65) Prior Publication Data

US 2002/0005220 A1 Jan. 17, 2002

Related U.S. Application Data

(62) Division of application No. 09/483,675, filed on Jan. 14, 2000.

(51) Int. Cl.[7] ..... G05D 7/00

(52) U.S. Cl. ..... 137/565.29; 137/565.16; 137/565.37

(58) Field of Search ..... 137/565.29, 565.16, 137/565.33, 565.37; 417/5

(56) References Cited

U.S. PATENT DOCUMENTS 3,730,884 A * 5/1973 Burns et al.
4,245,664 A * 1/1981 Johnson ..... 137/236.1
4,709,723 A 12/1987 Sidaway et al. ..... 137/584
5,439,180 A 8/1995 Baughman et al. ..... 241/36
5,503,533 A * 4/1996 Potter et al. ..... 417/63
5,562,254 A 10/1996 Sleasman et al. ..... 241/46.01
5,816,510 A 10/1998 Earle, III et al. ..... 241/46.01

OTHER PUBLICATIONS

"Finally a sewer system designed with the operator in mind.", Environment One Corporation, 1997.
"Engineered to do one job perfectly.", Environment One Corporation, Feb. 2, 1998.

* cited by examiner

*Primary Examiner*—A. Michael Chambers
(74) *Attorney, Agent, or Firm*—Drinker Biddle & Reath LLP

(57) ABSTRACT

A sewage system comprising a network of sewage sumps that temporarily store sewage produced in a dwelling or other structure, each of said sumps preferably comprising a computer controller for operating a pump in the sump such that the sewage collected in the sump may be pumped out of the sump and into the collection system in a controlled manner to regulate the flow of sewage material in the system. The regulation of the sewage flow permits the efficient operation of a sewage treatment facility that receives sewage from the network of sewage sumps by insulating the facility from the peak burdens that would be placed on it at certain times of day in the absence of a system that regulates sewage flow into the system at the source of the sewage.

12 Claims, 6 Drawing Sheets

CONTROLLED SEWAGE SUMP NETWORK SYSTEM

This application is a division of application Ser. No. 09/483,675, field Jan. 14, 2000.

FIELD OF THE INVENTION

The present invention is related to the field of sewage collection and treatment. A network of controllable sewage sumps having pumps and level detection equipment permits controlled flow of sewage to a central treatment facility.

BACKGROUND OF THE INVENTION

Most municipal sewage and wastewater collection and treatment systems comprise direct connections between residences and office/industrial buildings and a sewage collection pipeline that feeds into a main pipeline. The main pipeline enters a sewage treatment facility and the sewage carried therein is dispersed to treatment tanks. Commonly, the treatment facility must absorb the raw sewage as it is produced, which presents a flow rate that changes drastically during a typical day. Early in the morning there is a peak flow into the sewage system as the population arises from sleep and prepares for work and school. Flow rates decrease and level off through the daytime hours, only to increase again during the evening hours. Then, overnight, flow rates may drop to a nearly quiescent level.

In the future, it will become desirable to construct more efficient waste treatment facilities. One way to improve efficiency is to control the sewage flow throughout the network of sewage pipelines that feed into a waste treatment facility. When sewage flows can be reliably controlled in a system, it will not be necessary to construct and operate treatment facilities that must have sufficient capacity to handle the present peak input, which only occurs for a few short hours in the morning and evening. Such a system leaves idle capacity unused for most of the midday and overnight. A controlled system would deliver sewage to a treatment facility at a more consistent rate of flow lacking the peaks and lulls of a passive system.

SUMMARY OF THE INVENTION

The present invention is a controllable flow sewage system. The system comprises a plurality of computer controllable sewage sumps. Each sump contains a pump that moves sewage from the sump through an outlet pipe that is connected to a sewage collection line. The pump in each sewage sump is controlled by computer. The computer controller of one sump is linked to the computer controllers of the other constituent sumps in the system so that system wide sewage flow control may be achieved. Individual sewage sumps have the capability to sense the level of sewage material in them such that each controller can determine when and at what flow rate the sump may pump sewage into the collection line.

In one embodiment of the invention, the individual sump controllers communicate in and comprise a non-hierarchical (peer-to-peer) network in which each sump has the capacity to track how many of its peers are pumping sewage into the system and at what rate. Individual sump controllers can adjust their operation according to a planned, programmable maximum load that the system can sustain at any one time. The controllers can be programmed to absorb the peak input flows and spread the pumping of sewage over the non-peak hours of operation.

In another embodiment of the invention, the system may be controlled by a single master controller that commands the individual sump controllers to pump sewage into the system as needed to make best use of system capacity and smooth the peaks and lulls of system flow that would otherwise take place in a passive system.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE INVENTION

The present invention is a sewage system in which the flow rate of sewage through the system may be controlled by computer-controlled pumps located in each of a plurality of sewage sumps. A sewage sump is associated with one or more structures and collects the sewage waste from its associated structure(s). The sump has the capability of sensing the level of sewage within it. By operating the pump when the sump sewage level rises above a certain predetermined point, the sump can pump out sufficient sewage to lower the internal liquid level to a desired minimum. The pumping operation can be timed to occur over what would ordinarily be the lower demand periods for sewage system loading. The network of controllers in a system of such sumps can cooperate to absorb peak sewage input and pump the sewage into the collection system at a rate calculated to meter the sewage flow through the system over non-peak load hours of day and night.

The sewage sump component of the sewage network is similar to that described in co-pending patent application Ser. No. 09/150,568 filed Sep. 10, 1998. The sewage sump is a collection basin into which raw sewage from a dwelling or other building first flows before being passed into either a sewer system or a septic leaching field, depending upon the type of sewage system in place. In the present invention, the sewage sump is a temporary collection basin to hold sewage as it exits a dwelling or facility prior to pumping the contents into a private or municipal sewage system on a controlled basis. The present invention deals with sewage collection and treatment systems rather than isolated septic systems common to rural areas where large-scale waste treatment systems are not provided.

Figure 1:
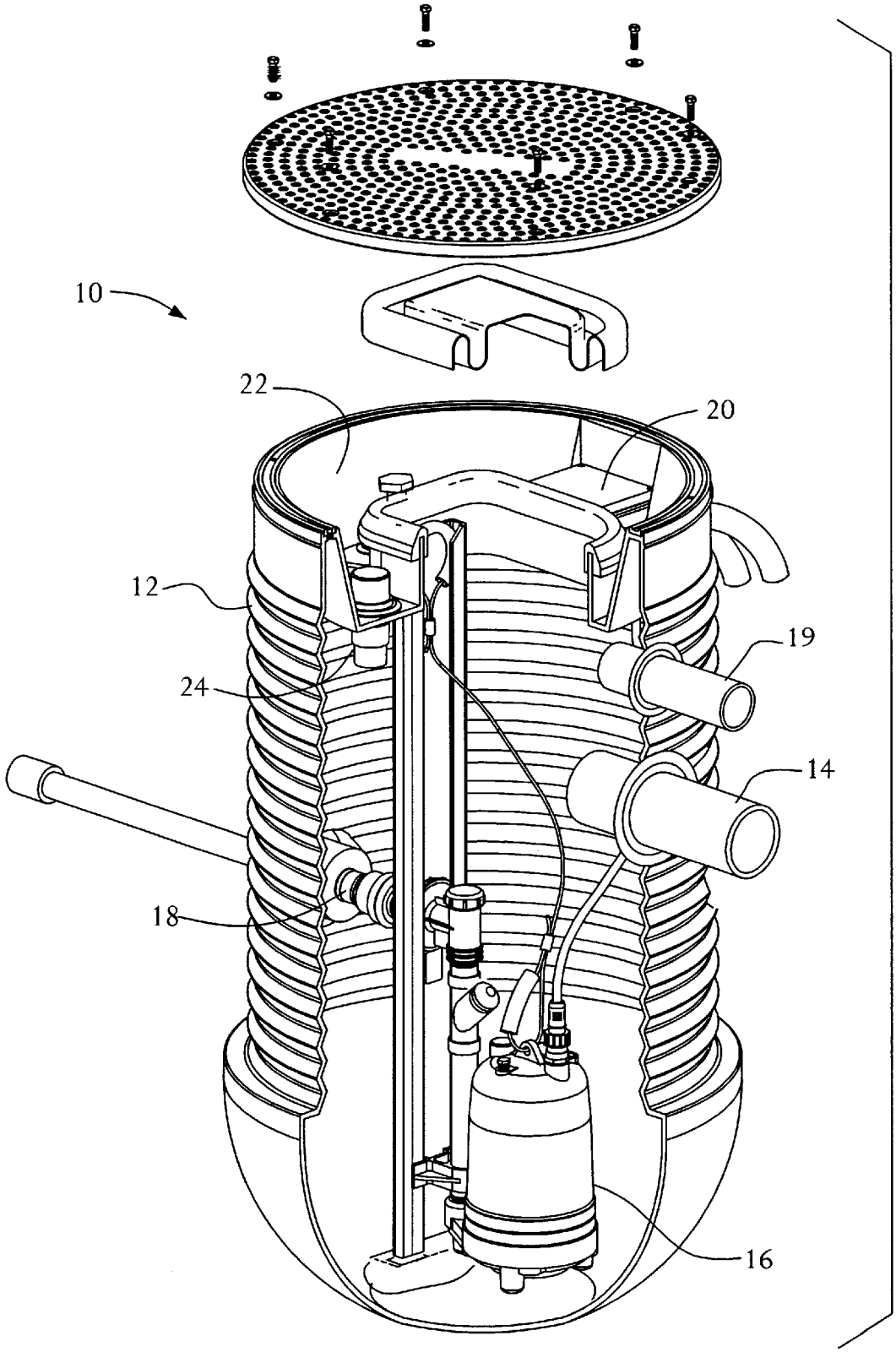
FIG. 1 is a partial cutaway section drawing of a controlled sewage sump.

Referring to FIG. 1, a sewage sump 10 comprises a basin 12 for the collection of sewage. The sump is typically buried in the ground near the facility that it serves. (See FIG. 2.) Sewage flows into the basin 12 through an inlet pipe 14. A grinder pump 16 inside the sump serves two purposes. First, it reduces the solids present in raw sewage by stirring the material in the sump and grinding up the solids such that the sewage material takes the form of a slurry. Second, the grinder pump 16 pumps the waste slurry out of the sump through an outlet port 18 and into the sewage system.

Most sewage sumps will be equipped with a vent pipe 19 for equalizing air pressure inside the sump as the content level rises and falls and for venting hazardous gasses to the atmosphere. A level detection device 24 is also present so that the physical liquid level inside the sump can be determined and reported to a controller. Several types of level detection devices may be adapted for use in the sewage sumps of the present invention. Level detection may be accomplished by mechanical means, such as floats, or by ultrasonic devices, or by electronic or optical devices. Any suitable device that is capable of being interfaced with a computer for communication of the detected level result in digital or other suitable form is functionally satisfactory.

In the described embodiment of the present invention, an important component of the sewage sump 10 is a computer controller 20. The controller 20 is located in a dry well 22 in the top of the sump, but in various embodiments the controller could be located outside the sump, or even at a remote location provided that a command control link exists between the remote controller and the pump inside the sump. As explained below, the control of the sewage sump network can be distributed in several ways, leading to several potential embodiments of the invention. All are considered to be within the scope of the invention.

Figure 2:
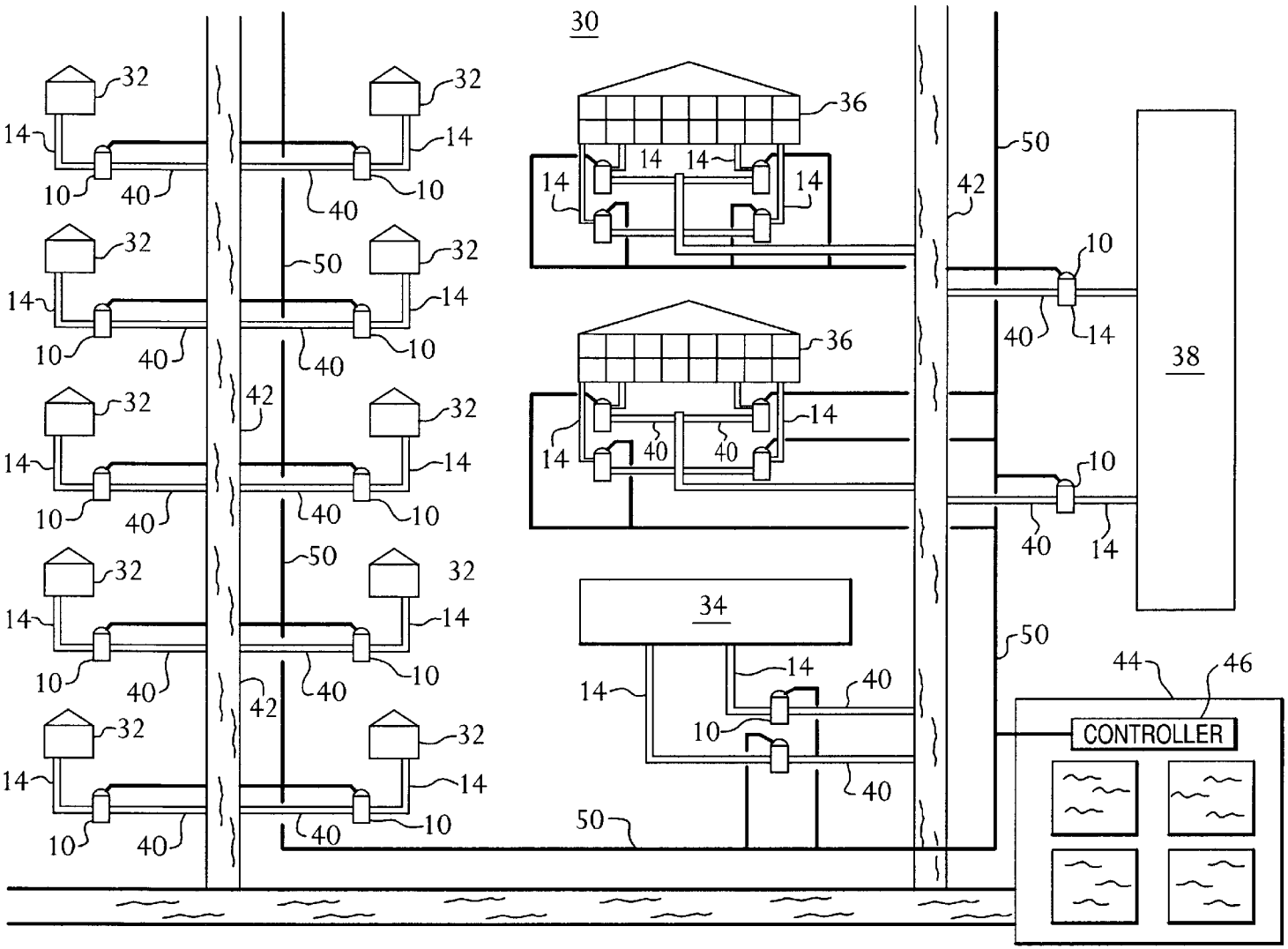
FIG. 2 is a schematic diagram of one embodiment of a controlled sewage sump network according to the present invention.

The scope of the present invention can best be appreciated by reference to FIG. 2, which depicts a graphic representation of a plurality of sewage sumps 10 arranged in one embodiment of a controllable network 30 according to the invention. Each individual sewage sump 10 is associated with a dwelling 32 or other structure, such as an office building 34, a multi-unit housing structure 36, or a retail store 38. More than one sewage sump 10 may be allocated to a single structure, as shown for the multi-unit housing structure 36.

Each sump collects sewage from its associated structure (s) through an inlet pipe 14. An outlet pipe 40 connects the sewage sump to a sewage collection main 42 that is the principal sewage pipeline for a street or neighborhood. Sewage flows from the sewage sumps 10 into a main 42 and thence to a central treatment facility 44. Along the way several sewage mains may combine into progressively larger pipelines capable of larger capacity, which is understood by those skilled in wastewater collection and treatment. It is not necessary for an understanding of the present invention to depict all of the possible permutations of feeder mains combining into larger mains in a typical municipal waste collection system. The invention focuses on the origin of the sewage and how that sewage enters the collection system on a metered basis for transport to a treatment facility.

Figure 3:
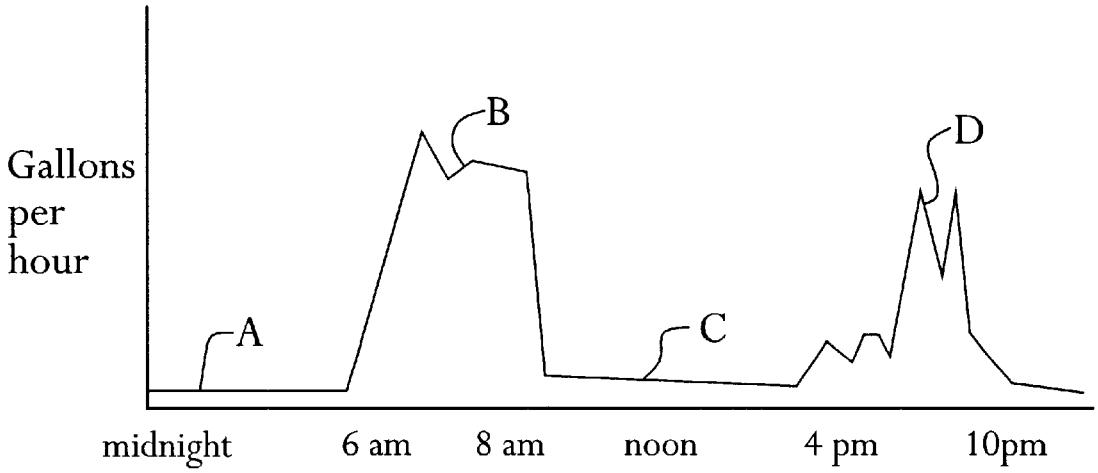
FIG. 3 is a chart of fluid flow versus time for sewage flow from a residence into a sewage sump.
Figure 4:
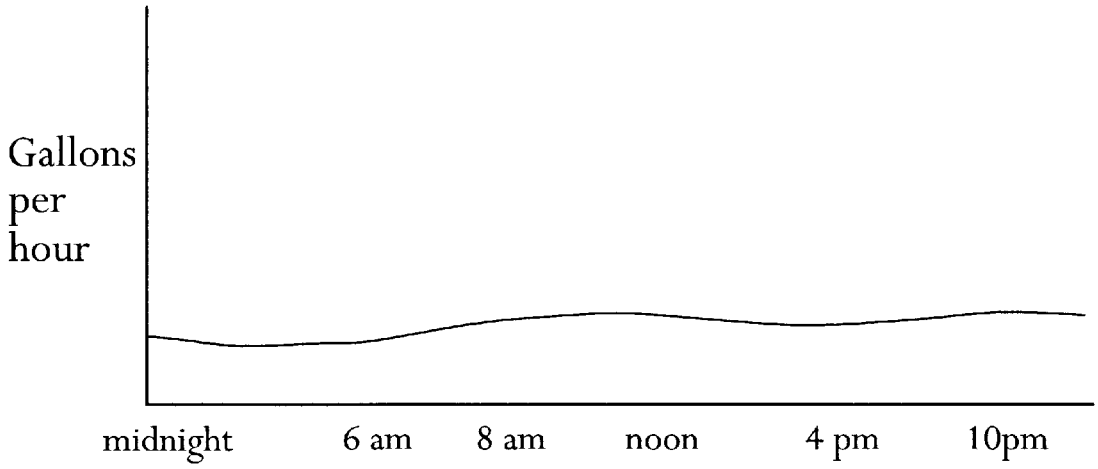
FIG. 4 is a chart of fluid flow versus time for sewage flow from a sewage sump into a controlled sewage network according to the invention.

Referring to FIG. 2, it can be seen that, in the absence of active control of the sewage generated in the network shown, the peak flow in the sewage system would be very heavy in the early morning and the evening. There is the potential for all of the structures shown in FIG. 2 to be creating sewage simultaneously and pumping it into the system without regard to the burden placed on the treatment facility 44. FIG. 3 is an illustration of the sewage burden that a typical household would impose on a sewage collection and treatment system absent a means of regulating the sewage input to the system. There are two peaks B and D associated with the morning and evening periods respectively. Periods of very low input occur overnight A and during the midday hours C. The input characteristic curve of FIG. 3 predicts the sewage burden on a sewage system serving a largely residential community. The system would require capacity to absorb the very high input peaks; capacity which would go unused during the very low input periods. That is inefficient. In the system of the invention, however, the sewage flow into the system is metered at the source. Each sewage sump 10 provides a holding basin for sewage produced from individual structures. It is therefore possible to pump sewage out of the individual sewage sumps and into the system in a controlled manner over all of the hours of the day and night. FIG. 4 illustrates the sewage flow into a collection system that is controlled per the present invention. The input flow of sewage into the system is spread over the full day and night hours, reducing peak loading on the system dramatically. Though sewage may flow to the sumps 10 in the network according to the flow characteristics shown in FIG. 3, the flow into the network 30 of controlled sumps 10 is characterized by the curve in FIG. 4.

Referring again to FIG. 1, the controlled sumps 10 in the network 30 are linked by a communications pathway 50 over which the sumps 10 may communicate with each other. The communications path 50 may also be a medium for sending control commands to the sump controllers 20 and for the controllers to provide status information to the network 30. The communications pathway 50 may take one of several forms. It may be a direct electrical bus that runs physically from one sump to another and to a network controller 46 if one is present. The pathway 50 can also be a radio-frequency (RF) link over which data can be transmitted and received. The pathway 50 may be an optical fiber network, or any other means of sending and receiving data.

In FIG. 2, the sewage network is depicted as having a network controller 46 at the treatment facility 44. This embodiment is a representation of a master-slave network control architecture in which the network controller 46 has command control over the individual sewage sump controllers 20 (FIG. 1) in the system. Another embodiment of the invention may be implemented in which a peer-to-peer architecture is employed. In a peer network, each sewage sump controller 20 is responsible for its own operation within the context of the network's overall design and function plan.

The control hierarchy in such a system is a matter of choice in that the invention focuses on controlling sewage flow from its source. It is conceivable that the control of a network according to the invention can be performed by a single computer, centrally located (such as at the treatment facility), and having direct control of the grinder pumps in each of the sewage sumps 10 in the system. However, this is not a desirable design from a reliability standpoint. A single point failure in the control computer can disable the entire system. Thus, it is more desirable to distribute control of each sewage sump 10 to small computers located in or near the individual sumps. All of the possible control hierarchies are within the scope of the present invention because the invention is a network of sewage sumps having controllable pumps in them to meter the flow of sewage into a sewage system. Any command control architecture that achieves this end is within the scope of the invention.

In the following description, the command control is distributed to the sump level where each sump has its own control computer. Two basic types of control architecture are described: (i) a master-slave network; and (ii) a peer-to-peer network. Other architectures are certainly possible.

Each sewage sump 10 has a computer controller 20, which can simply be a microcomputer comprising a microprocessor, memory, communications device (such as a modem), and an interface to the devices in the sump. One device in the sump that is important to the network is the level detection device 24. The level detector 24 serves as the check on how long a sewage sump can be idle, storing waste material, without pumping its contents into the sewage system. The level detection device 24 senses the level of sewage in the sump by electronic, mechanical, optical, sonic or other means and sends a signal to the microprocessor controller, which interprets the signal and compares the reported level to one or more setpoints in its memory. Typical setpoints can be: (i) empty (pump off); (ii) ready; (iii) full; (iv) emergency full. Other setpoints are possible depending on how intricate the control of an individual sump is desired to be.

At "empty", the sump controller keeps the grinder pump at idle (turned off). At "ready" level, the sump controller would report to the network controller that it has waste to pump. In a traditional sewage sump operation, shown in FIG. 5, where the pump has only two states (On/Off), the detection of the "ready" level would trigger the pump in the sump to pump the sump contents into the sewage collection system. Pumping would continue until the level of fluid in the sump returned to the "empty" (Off) level. The curve of the sump level over time would appear as at F in FIG. 5.

In the present invention, however, the network controller determines whether an individual sewage sump will be permitted to pump at a given time based on demand on the system, not simply on the level of sewage in a sump. The network controller may also determine the flow rate a sump may pump if that sump is capable of variable speed (i.e., flow) delivery of waste in to the system.

Once a sump's individual controller 20 receives authorization from the network controller 46, the sump controller may command the grinder pump in the sump to pump out waste into the sewer system. If the sewer system network controller is not prepared to accept waste from the sump, pumping may be delayed until the sewer network is ready to accept sewage input.

Figure 5:
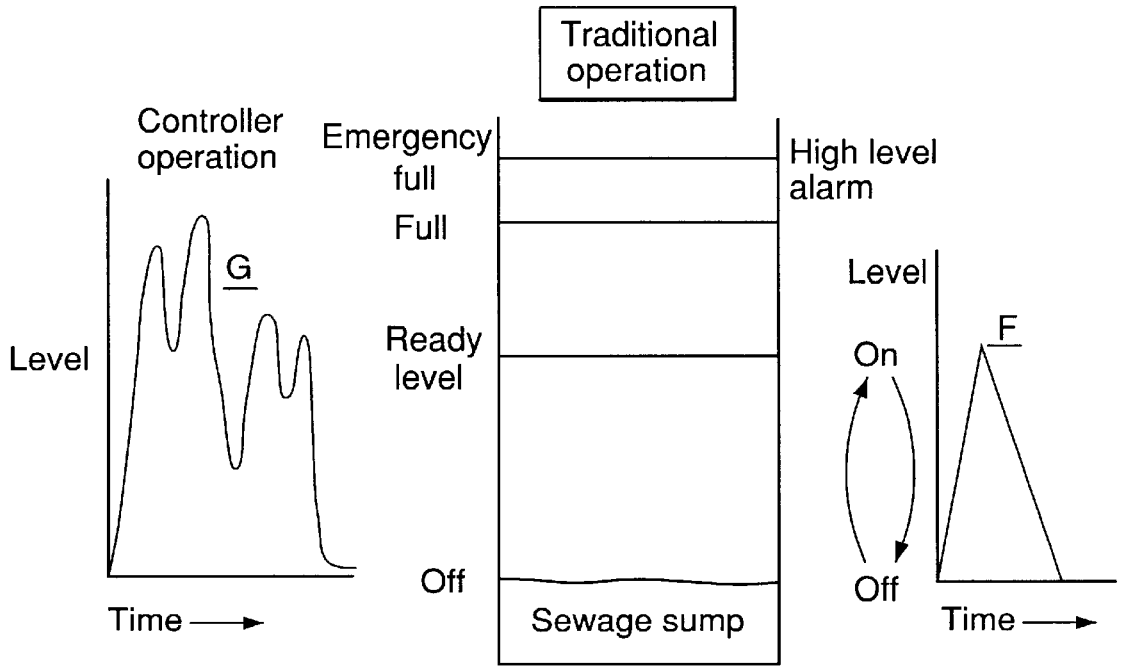
FIG. 5 is a combination graphic illustrating the flow characteristics of a traditionally controlled sewage sump and a sewage sump according to the invention that has controllable operation.

The characteristic curve of the sump level over time might appear as shown at G in FIG. 5. The level in the sump is permitted to pass "ready" before pumping begins and does not go all the way to empty once pumping commences. The pump only stays on as long as the network controller 46 permits. Thus, the sump level may rise again to the "full" level, at which point the sump controller 20 notifies the network controller that the "full condition has been reached.

When a sump level detector reports a "full" condition to the controller, the sump controller 20 must pump waste out of the sump. The sump controller must request immediate permission from the network controller to pump waste into the sewage network. The network controller 46 must accommodate the flow from the full sump, perhaps by shutting off other sumps temporarily. As shown at G in FIG. 5, the sump level drops again to nearly empty, then rises and falls twice more before the sump is allowed to be pumped to the empty state. Of course, the actual curve would vary from one sump to the next in a controlled system based on the demands on the system and how the network controller allocated pumping authorizations among the various sump controllers.

If the "emergency full" condition is reached, either the grinder pump is immediately activated by its local controller regardless of the network status or, if the pump will not operate or cannot clear the emergency condition, an alarm will be reported to the occupants of the structure being served by the individual sewage sump. In the latter case, it would be likely that either the sump's grinder pump had failed or the sump controller failed to operate properly.

The sump controller 20 can determine the flow rate at which waste is pumped from the sump in one of several ways. In sumps wherein the grinder pump is a fixed-speed unit, the flow rate of the pump is generally constant and can be programmed into the sump controller 20 so that the controller can estimate pumping time for the level of waste in the sump. This data may be reported to the network controller 46. If the pump is a controllable variable speed unit with its own computer controller, then the grinder pump controller can exchange speed and flow information with the sump controller 20. Obviously, if the sump controller 20 controls the speed of the grinder pump 16 directly, then the sump controller 20 has the speed and flow data within it already. This flow rate information may be reported to a network controller 46 in a master-slave network control configuration. The flow rate data can be used by the network controller 46 to manage the volume of sewage flowing into the sewage system at any given time.

Another control architecture embodiment of the invention is a peer-to-peer network. In a peer network, each sump 10 would have its own controller 20 and no controller has command over any of the other controllers. They do, however, communicate with each other and can be programmed to react to what is happening in the system. When a controller 20 starts its sump grinder pump 16 it notifies the network, which comprises all of the other sump controllers, and all of the controllers can "know" that a pump is active. If pump flow rate information is available, that information may also be reported to the peer network. In this way, a sump controller can make decisions on when to pump out its contents based on a substantial amount of data available from its neighbors.

When a sump level detection device indicates a "ready" level, the sump controller can check the time of day. If it is a peak demand period, the sump controller can delay pumping out its sump contents, or it can begin pumping at a low flow rate, if necessary. If many other sumps are pumping, no matter the time of day, an individual sump controller may delay evacuating its sump contents until fewer network sumps are active. Of course, if the sump goes to "full" or "emergency full" status, it must pump its contents. It can give notice of this condition to its peers, which can shut down pumping for a period in as many sumps as are not full at the time.

A peer network may not be as efficient as a master-slave network for smooth control of system load, but it can still be an effective means of distributing system demand over time. Both the peer network and the master-slave network can smooth the peaks and lulls of sewage system demand and the concomitant burden on the treatment system.

Figure 6:
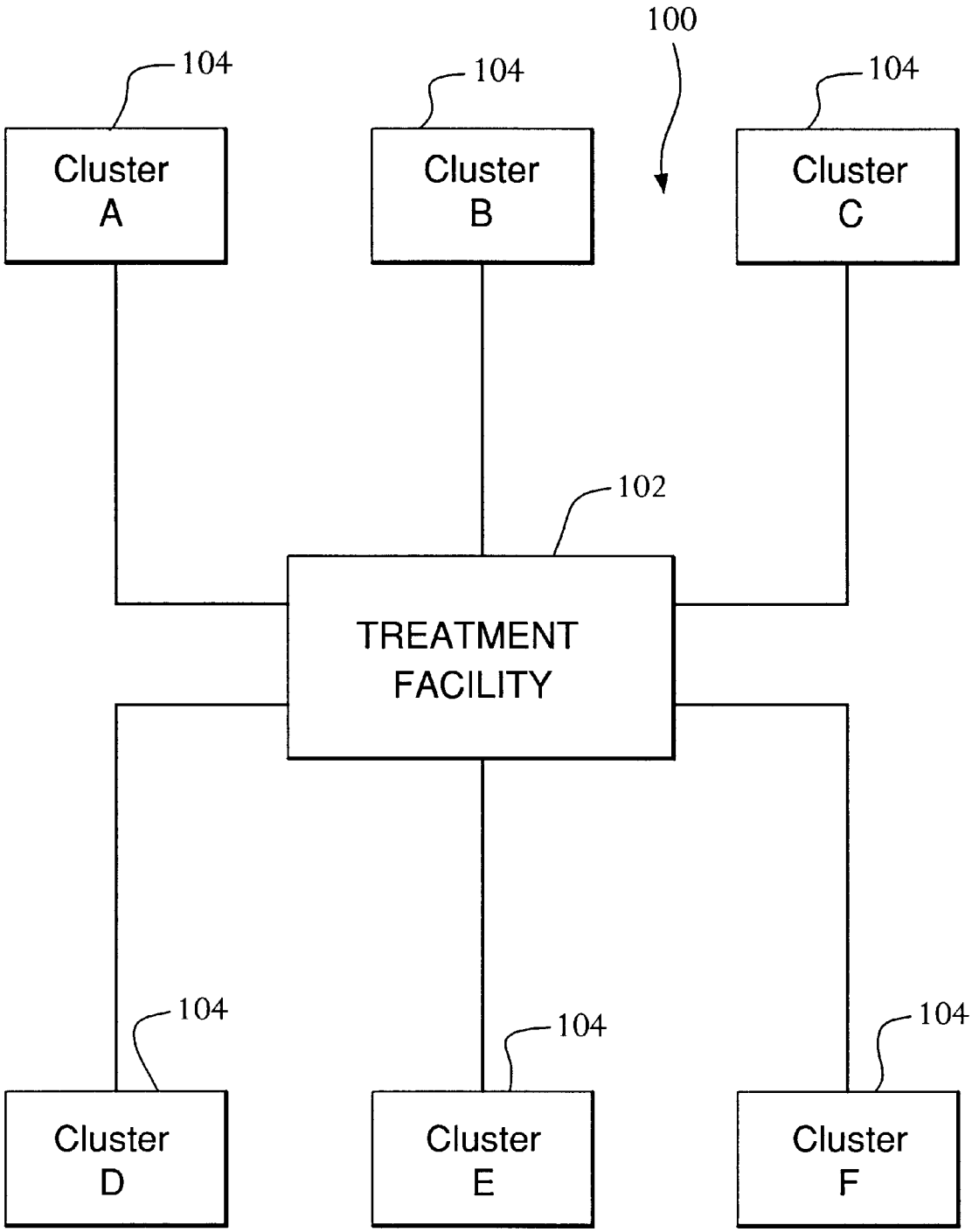
FIG. 6 is a block diagram of one embodiment of a distributed network control architecture.
Figure 7:
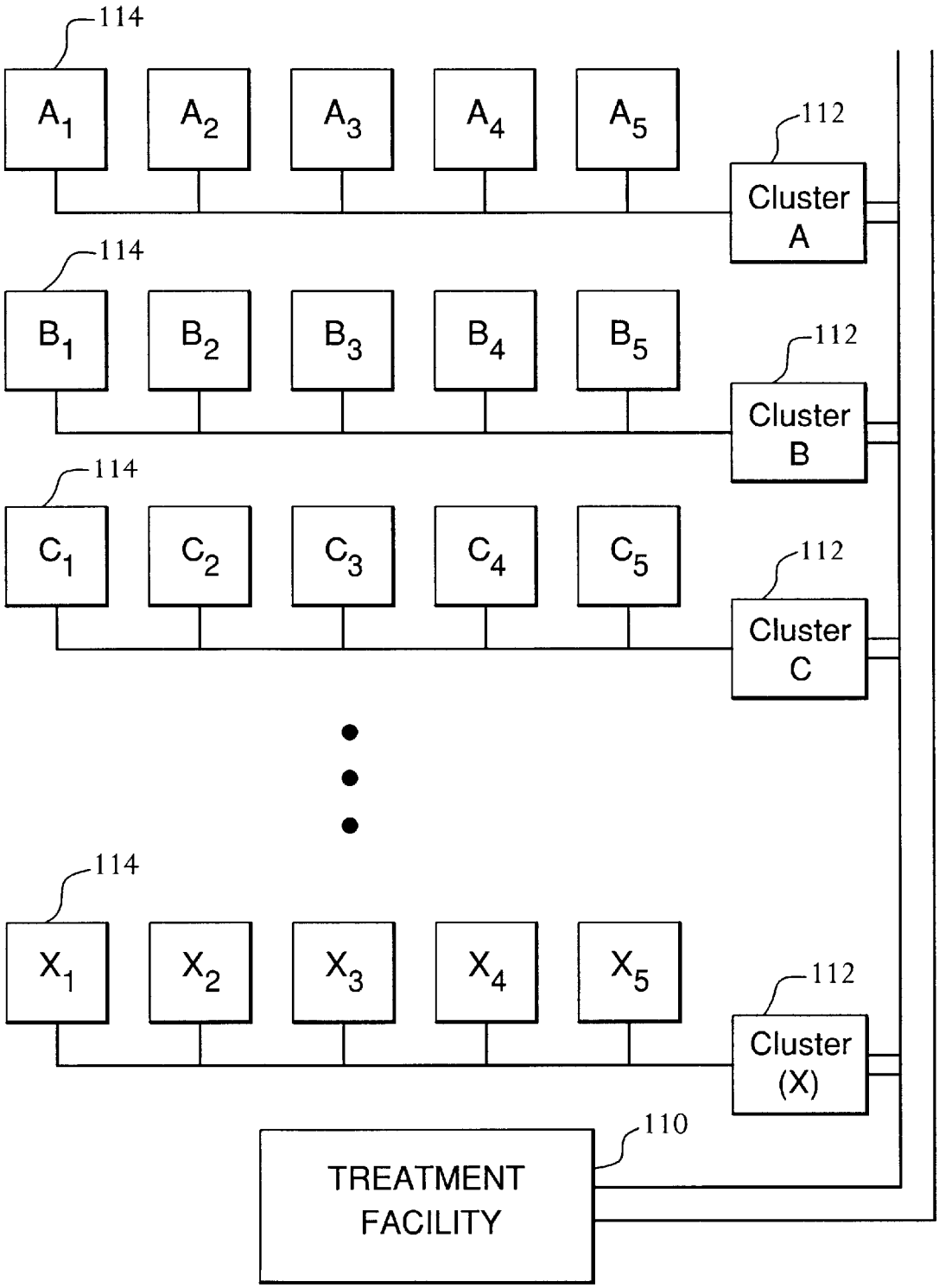
FIG. 7 is a block diagram of an alternative embodiment of a distributed network control architecture.

Other control architectures are possible by distributing control to various points in the system. FIG. 6 illustrates a system in which a controller at the treatment facility 102 of a sewage treatment system network 100 controls several distributed cluster controllers (104) A–F. The cluster controllers A–F control individual sump controllers (not shown) in each cluster that comprises the network 100. In FIG. 7, the controller at the treatment facility 110 controls a number of cluster controllers (112) A–x where x is the number of clusters in the network. Each cluster controller A–x controls several area controllers 114, such as $A_1$–$A_5$ for cluster A. The area controllers $A_1$–$A_5$ exercise control over individual sump controllers (not shown). These illustrations are by way of example and do not limit the architectures that may be devised for efficient flow control in any controlled sewage system according to the invention.

The present invention may be embodied in other specific forms without departing from the spirit or essential attributes thereof and, accordingly, reference should be made to the appended claims, rather than to the foregoing specification, as indicating the scope of the invention.

What is claimed is:

1. A sewage system comprising a network of controllable sewage sumps, said system comprising:

a sewage collection main for collection of sewage;

a plurality of sewage sumps having a capacity to temporarily store a quantity of sewage within them, said sumps each having a controllable pump for evacuating sewage from the sump into said sewage collection main;

at least one computer controller to govern the total flow of sewage from said sewage sumps into said sewage collection main by governing separately the flow from each said controllable pump into the sewage collection main.

2. The sewage system of claim 1, further comprising:

a communications pathway by which the sewage sumps can be individually controlled.

3. The sewage system of claim 2, further comprising:

in each of the sewage sumps, a computer controller that controls the pump in the sump and provides communication capability with other controllers in the network.

4. The sewage system of claim 3, further comprising:

in each of the sewage sumps, a level detector device, said device being capable of detecting the level of sewage material in the sump and converting the level to a data signal.

5. The sewage system of claim 3, wherein the at least one computer controller that governs the flow of sewage from the respective sumps into the sewage collection main is a master controller configured to receive data from the computer controller in each sewage sump and send commands to said sump controllers over the communications pathway.

6. The sewage system of claim 5, further comprising:

a sewage treatment facility into which the collected sewage flows for treatment.

7. A sewage system comprising:

a plurality of sewage sumps having a capacity to temporarily store a quantity of sewage within them prior to delivery of the sewage into a sewage collection main, each of said sewage sumps also comprising a computer controllable pump to pump the stored sewage into a sewage collection main;

said plurality of sewage sumps being interconnected in a network for command and control communication among the sumps such that the flow of sewage from the sumps into the sewage mains is controllable throughout the network; and at least one computer controller for governing the operation of the controllable pumps in the network of sewage sumps.

8. The sewage system of claim 7, wherein each of the sewage sumps comprises a computer controller, said controller effecting controllable operation of the sump and communicating with the network controller.

9. The sewage system of claim 7, wherein each of the sewage sumps comprises a level detector for determining the level of sewage material in the sump and converting the level information to a data signal.

10. A sewage system wherein the flow rate of sewage into the system may be controlled, said system comprising:

a plurality of computer-controlled sewage sumps, said sewage sumps each having a controllable pump for moving sewage from the sump to a sewage collection main;

said sewage sumps also each comprising a computer controller for operating the respective pumps and controlling the sewage flow out of each sump, said controllers each comprising one element of a control network for controllable operation of the system; and, a communications pathway by which the computer controllers may be linked in a network for control of the flow of sewage in the system.

11. The sewage system of claim 10, wherein each of the sewage sumps further comprises a level detector, said detector having the capability to determine the level of sewage material in the sump and convert the level to a data signal.

12. The sewage system of claim 10, further comprising a network computer controller, said controller effecting control of the network of controllable sewage sumps and thereby regulating the flow of sewage in the sewage system.

* * * * *